United States Patent [19]

Fischer et al.

[11] 4,002,016

[45] Jan. 11, 1977

[54] OPEN END SPINNING APPARATUS

[75] Inventors: Peter Fischer; Bruno Schmidt; Rolf Langer; Günter Trommer, all of Karl-Marx-Stadt, Germany

[73] Assignee: VEB Spinnereimaschinenbau, Karl-Marx-Stadt, Germany

[22] Filed: Aug. 13, 1975

[21] Appl. No.: 604,398

[30] Foreign Application Priority Data

Aug. 16, 1974 Germany ..... 180546

[52] U.S. Cl. ..... 57/58.95

[51] Int. Cl.[2] ..... D01H 1/12

[58] Field of Search ..... 57/58.89–58.95, 57/138

[56] References Cited

UNITED STATES PATENTS

| | | | |
|---|---|---|---|
| 3,107,478 | 10/1963 | Arshinov et al. | 57/58.95 |
| 3,411,284 | 11/1968 | Corbaz et al. | 57/58.91 |
| 3,696,603 | 10/1972 | Kotter et al. | 57/58.89 |

*Primary Examiner*—Richard C. Queisser
*Assistant Examiner*—Charles Gorenstein
*Attorney, Agent, or Firm*—Nolte and Nolte

[57] ABSTRACT

In an open end spinning apparatus for converting staple fibers into yarn, the apparatus comprising a rotor having a rotatable surface to which a substantially parallel array of the fibers is fed substantially along the axis of the rotor and by engagement with which the fibers are twisted together, the improvement comprising a needle non-rotatably mounted adjacent the rotor and having a free end impinging on the path of travel of the array of fibers to the rotor and being directed obliquely of the rotor axis in the direction of the rotor, whereby the needle engages the array of fibers and thereby holds back the fibers at that point from co-rotating with the fibers engaged by the rotor.

10 Claims, 4 Drawing Figures

OPEN END SPINNING APPARATUS

The present invention relates to apparatus for the preparation of yarn from staple fibers by the open end spinning method, in which the fibers are guided into a twisting zone.

In a well known apparatus of this kind, the fibers are transported to a rotor which is supported on one side, are twisted on the surface of the rotor and are pulled away over the top of the rotor in the direction of the axis of the rotor. The rotor serves to impart the twist and, consequently, exerts a hold-back force. It is imperative that the surface of the rotor have a certain minimum of roughness in order to produce sufficient moments of coupling in the direction of the rotation of the surface between the end of yarn and the surface so that the twist is imparted. It has been found that this minimum of roughness results in too high a hold-back force in the direction of the axis. Thus, the rotor must have a value of roughness in the direction of the circumference different from that in the direction of the axis. This is very difficult to accomplish, because the radius of the rotor must be as small as possible in order to conserve energy.

In another well known apparatus of this kind, twisting means are disposed upon both sides of the twisting zone. A fiber brush is arranged opposite the rotating yarn end. The fiber brush is fastened in a support which rotates in the same direction as the yarn end. The fiber brush is provided with stabilizing means, for example, one or more fine wires. The rpm of the brush is higher than the rpm of the yarn end. The fiber brush and the stabilizing means spread more and more as the rpm increases. Consequently, eventually the fiber brush throws fibers off the rotating yarn end, which leads to an interruption in the spinning process.

It is an object of the invention to increase the yield of a yarn of a good quality.

It is a further object of the invention to provide a device which produces a strong holding back force without significantly increasing the cost of the spinning apparatus.

Other objects and advantages of the invention will be apparent to one skilled in the art from the following description of the invention.

The objects of the invention are attained by non-rotatably arranging a needle opposite to the twister, the needle pointing generally toward the twister.

Preferably, the needle is resilient and in an apparatus in which the fibers are introduced by a pair of feed rollers and an electrostatic potential exists between the rollers and the twister. This construction may lead to fluctuations of tension in the yarn end. Preferably, to prevent the occurrence of fiber beards, the needle is curved and/or the angle between the tangent to the point of the needle and the axis of the twister is 0° to 45°. In order to prevent the electrostatic field from influencing the twisting action as much as possible, the distance between the needle point and the entrance of the twister is preferably 10 to 40 mm. and/or the distance between the needle and the adjacent feed roller is 1 to 10 mm. It has been found that particularly advantageous conditions for spinning are obtained when the diameter of the needle is 0.1 to 0.5 mm. Mounting the needle with electrical insulation so that it is electrically isolated improves the parameters of quality of the yarn. The uniformity of the yarn is improved when two adjacently disposed feed stations of the feed roller pair are arranged for one needle.

The invention will now be further described by reference to specific embodiments thereof, as illustrated in the drawings, in which.

Figure 1:
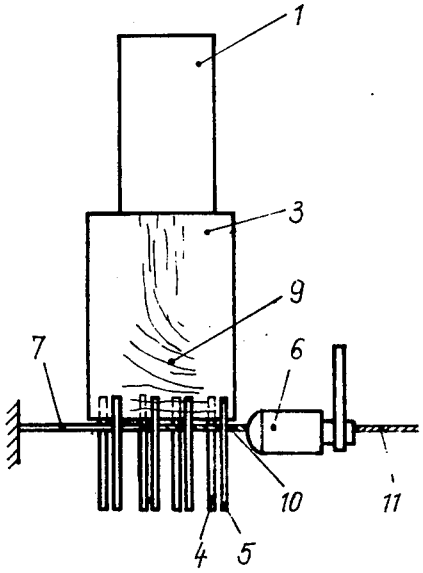
FIG. 1 is a front elevation of a spinning apparatus according to an embodiment of the invention.
Figure 2:
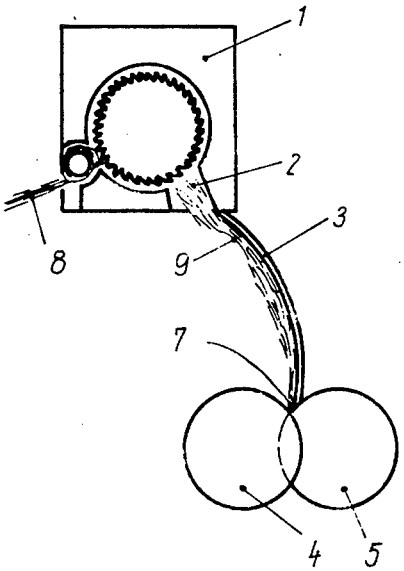
FIG. 2 is a side elevation of the apparatus of FIG. 1.

A well known disentangling unit 1 is followed at its exit opening 2 by a curved guiding sheet 3, the sheet 3 ending at pairs of discs 4 and 5, each disc 4 and 5 being axially offset from and overlapping the other disc of the pair (FIGS. 1 and 2). A twister 6 is located at one side of the device. A needle 7 is located opposite the twister 6. The needle is fixedly mounted with its point directed toward the twister.

The operation of the apparatus is as follows. The fiber band 8, which has been fed to and processed by the disentangling unit 1, is discharged onto the guiding sheet 3 completely separated into single fibers 9, the separation having been accomplished by an air stream which was produced by the disentangling unit 1. The sudden widening of the air stream cross section at the exit opening 2 and the deflection of the air stream by the guiding sheet 3 directs the fibers 9 vertically to the direction of their previous motion. The fibers 9 are thereby added to the yarn end 10 which is formed between the discs 4 and 5. The yarn end 10 receives an angular twisting motion by the twister 6, whereby the fibers 9, contained within the yarn end 10, are caused to surround the needle 7. The needle 7 exerts a holding back force upon the yarn end 10. The yarn 11 is pulled away and wound by conventional means (not illustrated).

A false twisting effect is prevented by rotating the discs 4, 5 in the same direction as the direction of rotation of the twister 6. Otherwise, false twisting might be caused by friction due to the fixed position of the needle 7 during the formation of the yarn 11.

Figure 3:
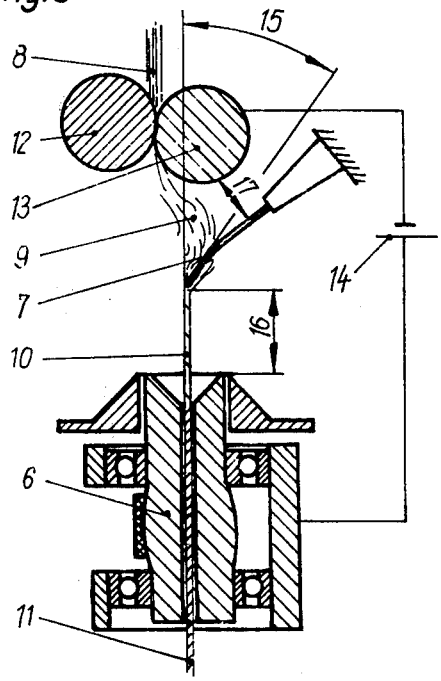
FIG. 3 is a side elevation of a second embodiment.

In the embodiment of FIG. 3, a source 14 produces an electrostatic field between the pair of feed rollers 12, 13 and the twister 6. The needle 7 is non-rotatably mounted opposite the twister 6 with its point directed toward the twister 6. Preferably, the needle 7 is resilient or resiliently mounted and curvilinearly shaped. The angle 15 between the tangent of the point of the needle 7 and the axis of the twister 6 is from 0° to 45°. The distance 16 between the point of the needle 7 and the entrance to the twister 6 is 10 to 40 mm., and the distance 17 between the needle 7 and the adjacent feed roller 13 is to 1 to 10 mm. The needle 7 has a diameter of 0.1 to 0.5 mm. and is electrically isolated by means of an electrically insulating mounting.

The embodiment of FIG. 3 operates as follows. The thin fiber band 8 is guided toward the electrical field by the pair of feed rollers 12, 13. The fibers 8 get oriented within the field and move in the direction of the entrance of the twister 6. The fibers 9 are also added onto the yarn end 10. The rest of the operation is identical to the above described embodiment.

Figure 4:
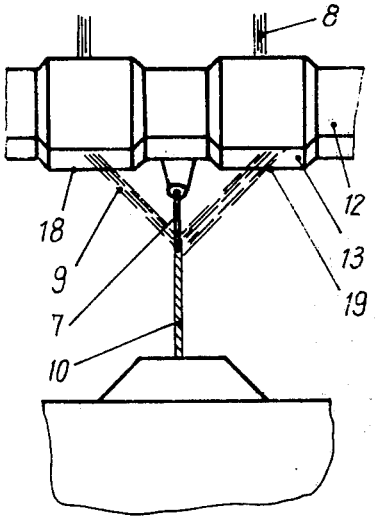
FIG. 4 is a side elevation of a third embodiment.

FIG. 4 shows an embodiment in which two adjacently disposed feed stations 18 and 19 are arranged at the feed roller pair 12, 13 for the needle 7.

What is claimed is:

1. In an open end spinning apparatus for converting staple fibers into yarn, the apparatus comprising a rotor having a rotatable surface to which a substantially parallel array of the fibers is fed substantially along the axis of the rotor and by engagement with which the fibers are twisted together, the improvement comprising a needle non-rotatably mounted adjacent the rotor and having a free end impinging on the path of travel of the array of fibers to the rotor and being directed in the direction of the rotor, whereby the needle engages the array of fibers and thereby holds back the fibers at that point from co-rotating with the fibers engaged by the rotor.

2. An open end spinning apparatus according to claim 1, further comprising a pair of driven rollers defining a nip through which the array of fibers is fed toward the rotor and means for generating an electrostatic field between the pair of rollers and the rotor for aligning the fibers with the axis of the rotor.

3. An open end spinning apparatus according to claim 2, in which the free end of the needle is pointed and the angle between a line tangential to the point of the needle and the rotor axis is from 0° to 45°.

4. An open end spinning apparatus according to claim 2, in which the needle is resiliently mounted.

5. An open end spinning apparatus according to claim 2, in which the needle is curved.

6. An open end spinning apparatus according to claim 3, in which the distance between the point of the needle and the nearest plane normal to the axis of the rotor and which intersects the rotor is from 10 to 40 mm.

7. An open end spinning apparatus according to claim 2, in which the distance between the needle and the nearer roller of said pair is from 1 to 10 mm.

8. An open end spinning apparatus according to claim 2, in which the diameter of the needle is from 0.1 to 0.5 mm.

9. An open end spinning apparatus according to claim 2, further comprising an electrically insulating mounting for the needle which mounting electrically isolates the needle.

10. An open end spinning apparatus according to claim 2, in which the feed rollers define two nips spaced apart from each other parallel to the axes of the rollers and through each nip is fed a respective parallel array of fibers toward the needle and the rotor.

* * * * *